US005657895A

United States Patent [19]

Rogge

[11] Patent Number: 5,657,895

[45] Date of Patent: Aug. 19, 1997

[54] FOOD CONTAINER

[76] Inventor: Dwaine W. Rogge, Unit 248 4159 Steck Ave., Austin, Tex. 78759

[21] Appl. No.: 564,617

[22] Filed: Nov. 29, 1995

[51] Int. Cl.[6] ..... B65D 51/16

[52] U.S. Cl. ..... 220/366.1; 220/608; 220/796; 215/307; 215/374

[58] Field of Search ..... 220/366.1, 353, 220/356, 608, 609, 796; 215/307, 316, 374, 377

[56] References Cited

U.S. PATENT DOCUMENTS

| | | | |
|---|---|---|---|
| 895,317 | 8/1908 | Vasaly | 215/276 X |
| 1,495,722 | 5/1924 | Anderson | 215/307 |
| 2,286,865 | 6/1942 | Martin | 215/307 X |
| 2,287,746 | 6/1942 | Morton | 215/307 |
| 3,216,148 | 11/1965 | Amberg | 215/307 X |
| 3,339,786 | 9/1967 | Biglin | 220/336.1 X |
| 3,437,224 | 4/1969 | Williams | 215/307 |
| 4,190,170 | 2/1980 | Boyd | 215/307 |
| 5,282,874 | 2/1994 | Tsukagoshi | 220/366.1 X |
| 5,340,550 | 8/1994 | Johnsen et al. | 220/366.1 X |

*Primary Examiner*—Stephen Cronin
*Attorney, Agent, or Firm*—Zarley, McKee, Thomte, Voorhees & Sease; Mark D. Frederiksen

[57] ABSTRACT

A food storage container includes a cylindrical barrel with an enclosed bottom for receiving a plurality of toroid shaped food products, such as bagels. A lid is provided for the open upper end of the barrel which permits air to pass into the barrel when the lid is attached to the barrel. A plurality of generally L-shaped ribs are mounted in the lid, with vertical legs projecting inwardly from the lid side wall inner surface, and horizontal legs projecting downward from the lid plate lower surface. The ribs in the lid space the lid side wall and plate away from the barrel upper end to form an air gap.

7 Claims, 3 Drawing Sheets

FOOD CONTAINER

TECHNICAL FIELD

The present invention relates generally to containers for holding food products, and more particularly to an improved container with a lid permitting air circulation within the container.

BACKGROUND OF THE INVENTION

Bagels have become a popular food product throughout the country. However, storing bagels in a closed container for any length of time will cause the outer surface, or "crust" of the bagel to become soft. Fresh bagels preferably have a relatively hard "crust" while maintaining a soft interior.

On the other hand, leaving bagels out on an open tray has the opposite effect, causing the "body" of the bagel to become hard and chewy. In addition, arrangement of bagels on an open tray takes valuable counter space for retail establishments.

SUMMARY OF THE INVENTION

It is therefore a general object of the present invention to provide an improved food container which permits air circulation within the container.

Another object is to provide a food container which will provide effective storage of bagels, while preventing the exterior surface of the bagel from becoming soft.

A further object of the present invention is to provide an improved food container which permits easy access to food product within the container, and displays the food product in an aesthetically pleasing manner.

Still another object is to provide an improved food container which is economical to manufacture, simple to use, and refined in appearance.

These and other objects will be apparent to those skilled in the art.

The food storage container of the present invention includes a cylindrical barrel with an enclosed bottom for receiving a plurality of toroid shaped food products, such as bagels. A lid is provided for the open upper end of the barrel which permits air to pass into the barrel when the lid is attached to the barrel. A plurality of generally L-shaped ribs are mounted in the lid, with vertical legs projecting inwardly from the lid side wall inner surface, and horizontal legs projecting downward from the lid plate lower surface. The ribs in the lid space the lid side wall and plate away from the barrel upper end to form an air gap.

DESCRIPTION OF THE PREFERRED EMBODIMENT

Figure 1:
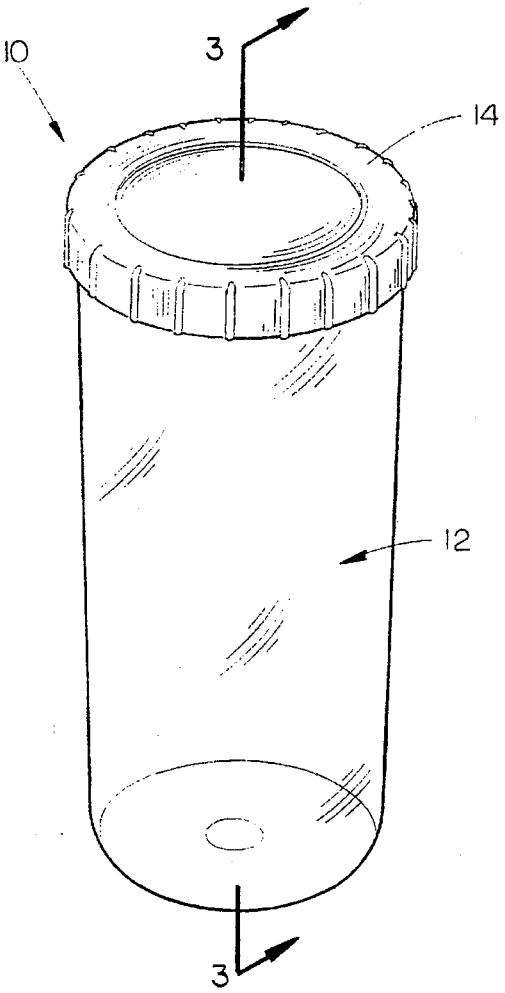
FIG. 1 is a perspective view of the food container of the present invention.

Referring now to the drawings, in which similar or corresponding parts are identified with the same reference numeral, and more particularly to FIG. 1, the food container of the present invention is designated generally at 10 and includes a barrel 12 with a removable lid 14.

Figure 2:
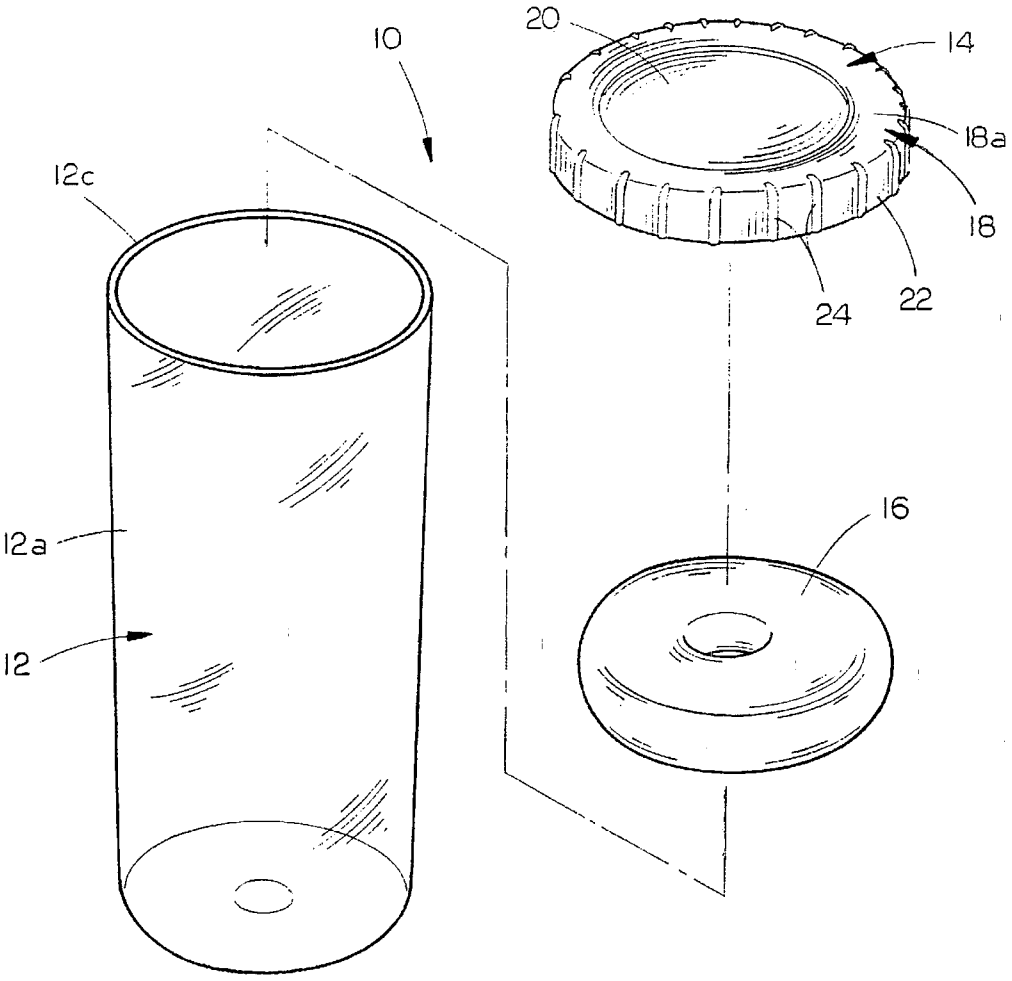
FIG. 2 is an exploded perspective view of the container with a bagel arranged for insertion therein.

Referring now to FIG. 2, barrel 12 includes a generally cylindrical side wall 12*a*, a disk-shaped bottom 12*b* enclosing the lower end of barrel 12, and an annular top edge 12*c* forming an open upper end of barrel 12. While container 10 may be utilized with a variety of food products, it is designed specifically to receive the toroid shape of a plurality of bagels 16.

Lid 14 includes a disk-shaped plate 18 having a circular depression 20 formed in the upper surface 18*a* thereof. Depression 20 is designed to receive a brand label or the like therein. A cylindrical side wall 22 depends from the circumferential edge of plate 18 and has a plurality of vertically oriented and uniformly spaced apart ribs 24 projecting radially outwardly therefrom. Ribs 24 permit easy gripping of lid 14 for removing the lid from barrel 12.

Figure 3:
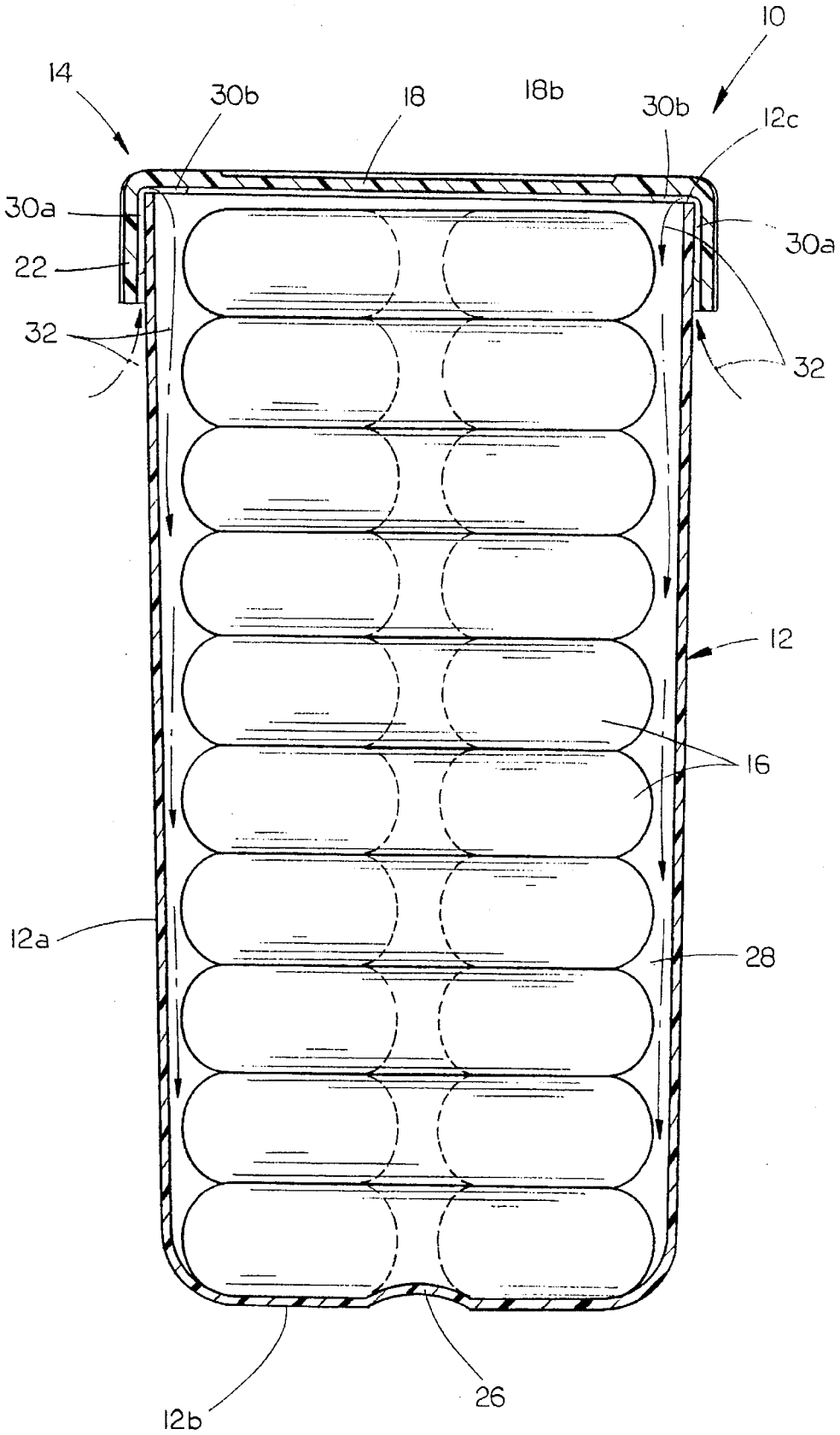
FIG. 3 is a vertical sectional view taken at lines 3—3 in FIG. 1.

Referring now to FIG. 3, barrel 12 is shown with a plurality of bagels 16 stacked within the exterior thereof. A "bump" 26 is formed in the center of bottom 12*b* and projects generally spherically upwardly into the interior cavity 28 of barrel 12. Bump 26 projects a distance to snugly receive the toroid shape of a bagel 16 and center the bagel on bottom 12*b* spaced away from the interior surface of side wall 12*a*.

Preferably, barrel 12 is formed of a crystal styrene material which is clear, to permit viewing of product within the container 10. Side wall 12*a* is tapered slightly outwardly from bottom 12*b* to top edge 12*c* to cause a friction fit with lid 14, as described in more detail hereinbelow. The inventor has found that a taper of approximately 1° from vertical is sufficient to provide the desired friction fit of lid 14.

Figure 4:
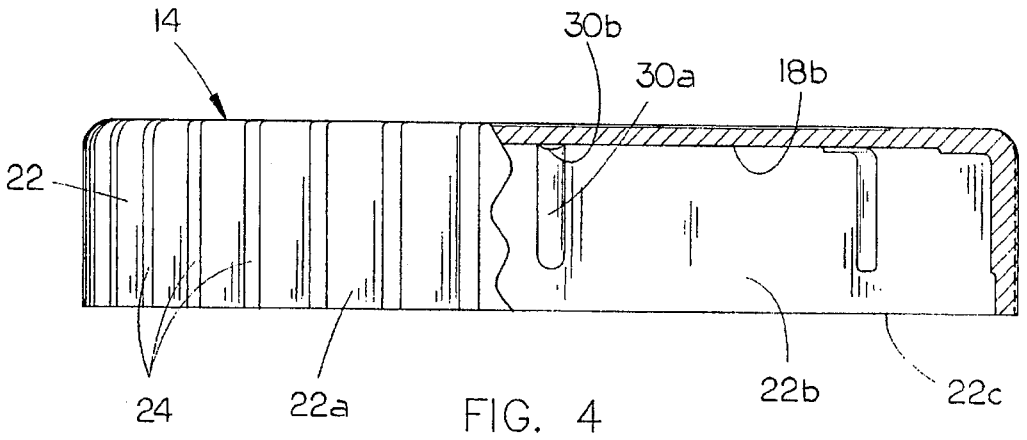
FIG. 4 is a side elevational view of the lid of the container, with a portion shown in sectional view.
Figure 5:
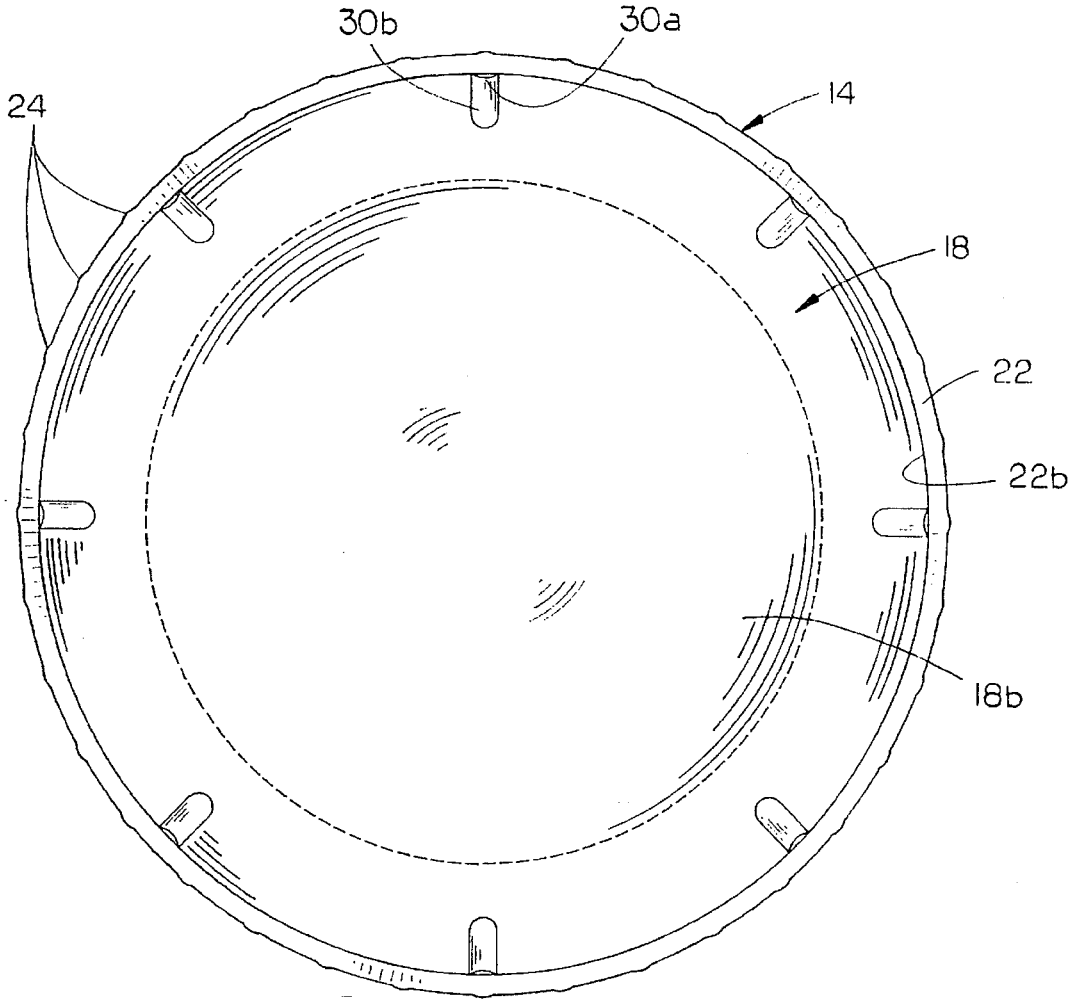
FIG. 5 is a bottom elevational view of the container lid.

Referring now to FIGS. 4 and 5, lid plate 18 has a flat lower surface 18*b* and side wall 22 as a cylindrical inward surface 22*b*. Ribs 24 are preferably spaced uniformly along the side wall outer surface 22*a* and extend fully from the upper to the lower edges of the side wall outer surface 22*a*.

A plurality of generally L-shaped inner ribs 30 are provided along side wall inner surface 22*b*. Each inner rib includes a vertical leg 30*a* extending downwardly from the lower surface 18*b* of plate 18 and projecting radially inwardly. Vertical legs 30*a* have an arcuate outer surface with a truncated cylindrical shape, as shown in FIG. 5. Vertical legs 30*a* do not extend completely to the lower edge 22*c* of lid side wall 22, and have a rounded lower end.

Each inner rib 30 also has a short horizontal leg 30*b* projecting radially inwardly from side wall inner surface 22*b*. Each horizontal leg 30*b* has an arcuate outer surface with a truncated cylindrical shape, as shown in FIG. 4, and with a rounded inward end. Side wall 22 of lid 14 preferably slants outwardly at an approximate angle of 1° from the plate 18 to the side wall lower edge 22*c*.

Referring once again to FIG. 3, it can be seen that the diameter of lid 14 as measured between the lower ends of the projecting ridges of ribs 30 is greater than the outer diameter of the upper end of barrel 12, while the diameter between the upper ends of rib vertical legs 30*a* is less than the outer diameter of the barrel upper end. Thus, as lid 14 is placed on the upper end of barrel 12, the upper end of barrel 12 will frictionally engage the vertical legs 30*a* of the inner ribs 30. At the same time, the horizontal legs 30*b* will form a gap above barrel upper edge 12*c* and lid plate lower surface 18*b*. Arrows 32 indicate air flow through the gaps between barrel side wall 12*a* and lid side wall 22, as well as between barrel upper edge 12*c* and lid plate 18.

Whereas the invention has been shown and described in connection with the preferred embodiment thereof, many modifications, substitutions and additions may be made which are within the intended broad scope of the appended claims.

I claim:

1. A food storage container, comprising:

an elongated generally cylindrical barrel having a generally vertical peripheral wall with upper and lower ends and inward and outward surfaces;

a bottom affixed to the lower end of the barrel to form a closed lower end;

a lid removably mounted on the upper end of the barrel for substantially enclosing the upper end of the barrel;

said lid including a generally horizontal plate with upper and lower surfaces and a peripheral edge, and a generally cylindrical side wall depending from the peripheral edge of the lid, said side wall including inward and outward generally vertical surfaces and a lower edge; and means located between the upper end of the barrel and the lid for spacing the lid plate above the barrel upper edge and for spacing the lid side wall inner surface outwardly away from the barrel side wall outer surface and for preventing the formation of an air-tight seal between the lid and the barrel, whereby an air gap is formed to permit air circulation into and out of the barrel when the lid is attached to the upper end of the barrel;

said means between the upper end of the barrel and the lid including:

a plurality of ribs formed on the lid and uniformly spaced apart, each rib having a vertical leg on the inward surface of the lid side wall and projecting radially inwardly over the barrel upper end, and a horizontal leg on the lid plate lower surface and projecting downwardly therefrom;

said rib legs located to space the rib plate and side wall away from the barrel and prevent an air-tight seal when the lid is attached to the barrel upper end;

said vertical rib legs each having an arcuate outer surface;

said rib vertical legs being arranged in diametric pairs;

the diameter of the lid between lower ends of a diametric pair being greater than the outer diameter of the upper end of the barrel; and the diameter of the lid at upper ends of diametric rib pairs being less than the outer diameter of the barrel, the lid inner diameter tapering outwardly from the upper to the lower end of said ribs.

2. The container of claim 1, wherein said lid side wall tapers outwardly from the upper end to the lower edge, forming a tapered diameter increasing from the upper end to the lower edge of the lid side wall.

3. The container of claim 2, wherein said lid side wall tapers outwardly at an angle of approximately 1° from vertical.

4. The container of claim 1, wherein the barrel side wall tapers outwardly from the lower end to the upper edge to create an increasing diameter from the barrel lower end to the upper edge.

5. The container of claim 4, wherein said barrel side wall tapers at an angle of approximately 1° from vertical.

6. A food storage container, comprising:

an elongated generally cylindrical barrel having a generally vertical peripheral wall with upper and lower ends and inward and outward surfaces;

a bottom affixed to the lower end of the barrel to form a closed lower end;

a lid removably mounted on the upper end of the barrel for substantially enclosing the upper end of the barrel;

said lid including a generally horizontal plate with upper and lower surfaces and a peripheral edge, and a generally cylindrical side wall depending from the peripheral edge of the lid, said side wall including inward and outward generally vertical surfaces and a lower edge; and means located between the upper end of the barrel and the lid for spacing the lid plate above the barrel upper edge and for spacing the lid side wall inner surface outwardly away from the barrel side wall outer surface and for preventing the formation of an air-tight seal between the lid and the barrel, whereby an air gap is formed to permit air circulation into and out of the barrel when the lid is attached to the upper end of the barrel;

the bottom having an upper surface with a bump projecting upwardly from the center thereof, to center a toroid shaped food product on the bottom of the barrel.

7. The food container of claim 6, wherein said bump has an upper surface which is spherical in shape.

* * * * *